US012466689B2

(12) United States Patent
Inaba et al.

(10) Patent No.: US 12,466,689 B2
(45) Date of Patent: Nov. 11, 2025

(54) BINDING APPARATUS

(71) Applicant: FUJIFILM Business Innovation Corp., Tokyo (JP)

(72) Inventors: Nobuhide Inaba, Kanagawa (JP); Kumiko Tanaka, Kanagawa (JP); Takashi Ogino, Kanagawa (JP); Masashi Matsumoto, Kanagawa (JP); Takumi Uegane, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 388 days.

(21) Appl. No.: 17/949,618

(22) Filed: Sep. 21, 2022

(65) Prior Publication Data

US 2023/0312300 A1 Oct. 5, 2023

(30) Foreign Application Priority Data

Mar. 29, 2022 (JP) ..... 2022-052871

(51) Int. Cl.
*B65H 37/04* (2006.01)

(52) U.S. Cl.
CPC ..... *B65H 37/04* (2013.01); *B65H 2515/805* (2013.01); *B65H 2801/27* (2013.01)

(58) Field of Classification Search
CPC ..... B65H 37/04; B65H 2301/51616; B65H 2301/5162; B65H 2301/43828; G03G 2215/00852; G03G 15/6544; B31F 1/00; B31F 1/07; B31F 5/02; B31F 2201/0707; B31F 2201/0754; B31F 2201/0771; B31F 2201/0784
USPC ..... 270/58.07, 58.08
See application file for complete search history.

(56) References Cited

U.S. PATENT DOCUMENTS

| | | | | |
|---|---|---|---|---|
| 9,399,841 | B2 * | 7/2016 | Yamada | B31D 1/0075 |
| 10,603,945 | B2 * | 3/2020 | Matsumoto | B42B 4/00 |
| 10,632,706 | B2 * | 4/2020 | Makita | B65H 37/04 |
| 10,654,240 | B2 * | 5/2020 | Takahashi | B65H 37/04 |
| 11,014,325 | B2 * | 5/2021 | Takahashi | B65H 31/3081 |
| 11,383,951 | B2 * | 7/2022 | Kawakami | B41J 11/58 |
| 2020/0317462 | A1 * | 10/2020 | Kawakami | B42B 5/00 |
| 2022/0334525 | A1 * | 10/2022 | Sasaki | G03G 15/6544 |

FOREIGN PATENT DOCUMENTS

JP 2014-201432 A 10/2014

* cited by examiner

*Primary Examiner* — Leslie A Nicholson, III
(74) *Attorney, Agent, or Firm* — Oliff PLC

(57) ABSTRACT

A binding apparatus includes a binder configured to bind sheets of paper by advancing binding teeth toward the sheets of paper, a water adjuster configured to adjust an amount of water contained in the sheets of paper, and a processor configured to, based on a setting on one of the binder or the water adjuster, make a setting on the other one of the binder or the water adjuster.

19 Claims, 8 Drawing Sheets

FIG. 8

| ADVANCING AMOUNT / WATER ADJUSTMENT AMOUNT | ･･ | ･･ | ･･ | ･･ | ･･ | ･･ |
|---|---|---|---|---|---|---|
| ･･ | ･･･% | ･･･% | ･･･% | ･･･% | ･･･% | ･･･% |
| ･･ | ･･･% | ･･･% | ･･･% | ･･･% | ･･･% | ･･･% |
| ･･ | ･･･% | ･･･% | ･･･% | ･･･% | ･･･% | ･･･% |
| ･･ | ･･･% | ･･･% | ･･･% | ･･･% | ･･･% | ･･･% |
| ･･ | ･･･% | ･･･% | ･･･% | ･･･% | ･･･% | ･･･% |
| ･･ | ･･･% | ･･･% | ･･･% | ･･･% | ･･･% | ･･･% |
| ･･ | ･･･% | ･･･% | ･･･% | ･･･% | ･･･% | ･･･% |
| ･･ | ･･･% | ･･･% | ･･･% | ･･･% | ･･･% | ･･･% |

BINDING APPARATUS

CROSS-REFERENCE TO RELATED APPLICATIONS

This application is based on and claims priority under 35 USC 119 from Japanese Patent Application No. 2022-052871 filed Mar. 29, 2022.

BACKGROUND

(i) Technical Field

The present disclosure relates to a binding apparatus.

(ii) Related Art

Japanese Unexamined Patent Application Publication No. 2014-201432 discloses a paper post-processing apparatus including a water adder that adds water into binding areas of sheets of paper, and a controller that changes and adjusts a water addition amount.

SUMMARY

Aspects of non-limiting embodiments of the present disclosure relate to the following circumstances. Paper binding is affected by various factors. The binding may be performed in consideration of a plurality of factors in such a manner that one factor is changed and the other factors are also changed in response to the change of one factor.

Aspects of non-limiting embodiments of the present disclosure therefore relate to more secure paper binding compared with paper binding performed in consideration of any one factor out of a paper binding amount and a water amount in paper.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a binding apparatus comprising: a binder configured to bind sheets of paper by advancing binding teeth toward the sheets of paper; a water adjuster configured to adjust an amount of water contained in the sheets of paper; and a processor configured to, based on a setting on one of the binder or the water adjuster, make a setting on the other one of the binder or the water adjuster.

BRIEF DESCRIPTION OF THE DRAWINGS

An exemplary embodiment of the present disclosure will be described in detail based on the following figures, wherein:

FIG. 8 illustrates a relational table.

DETAILED DESCRIPTION

An exemplary embodiment of the present disclosure is described in detail with reference to the accompanying drawings.

Figure 1:
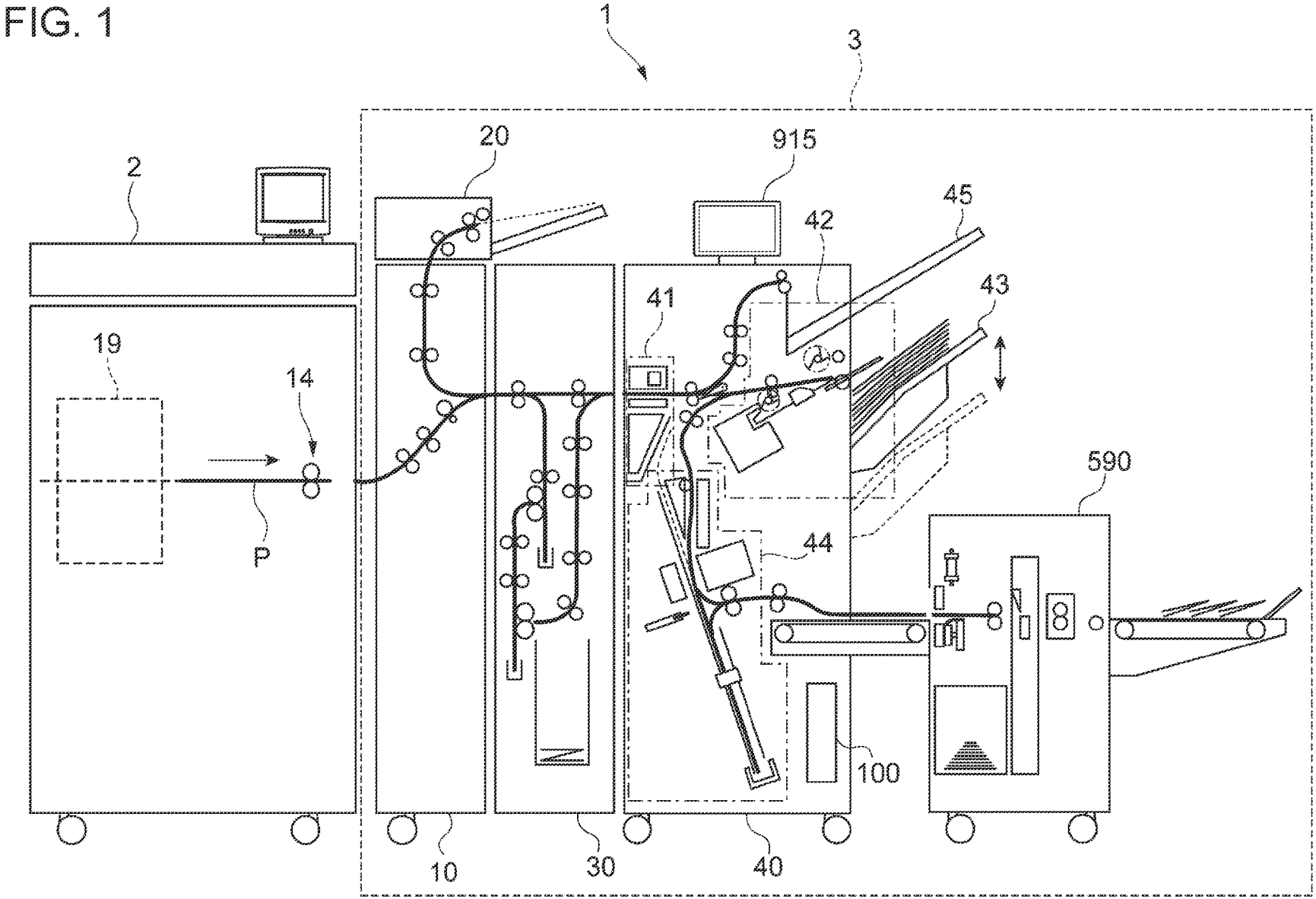
FIG. 1 illustrates the overall structure of an image forming system.

FIG. 1 illustrates the overall structure of an image forming system 1.

In FIG. 1, the image forming system 1 includes an image forming apparatus 2 that forms an image on paper P that is an example of a recording medium, and a paper processing apparatus 3 that performs a predetermined process on the paper P having the image formed by the image forming apparatus 2.

The image forming apparatus 2 includes an image forming unit 19 that forms an image on the paper P by an electrophotographic or inkjet system.

The image forming apparatus 2 includes a fixing device 14. The fixing device 14 is disposed on a downstream side of the image forming unit 19 in a transport direction of the paper P.

The fixing device 14 pressurizes and heats the paper P with an image. Thus, the image on the paper P is fixed onto the paper P.

The paper processing apparatus 3 that is an example of a processing apparatus includes a transport device 10 that transports the paper P downstream from the image forming apparatus 2, and an inserting paper feeding device 20 that feeds inserting paper such as thick or window paper P to the paper P transported by the transport device 10.

The paper processing apparatus 3 includes a folding device 30 that performs a folding process such as inward triple folding (C-folding) or outward triple folding (Z-folding) on the paper P transported from the transport device 10.

The paper processing apparatus 3 includes a first post-processing device 40 that is provided on a downstream side of the folding device 30 and performs, for example, punching, edge binding, or saddle stitching on the paper P.

On the downstream side of the folding device 30, the first post-processing device 40 performs a process on a paper bundle including a plurality of sheets of paper P having images formed by the image forming apparatus 2, or a process on each sheet of paper P.

The paper processing apparatus 3 includes a second post-processing device 590 that is provided on a downstream side of the first post-processing device 40 and processes a bundle of paper P that has undergone central folding or saddle stitching.

The paper processing apparatus 3 includes an information processor 100 including a central processing unit (CPU) that executes programs and configured to control the entire paper processing apparatus 3.

The paper processing apparatus 3 includes an information display 915 that is a liquid crystal monitor or the like and displays information for users.

The first post-processing device 40 includes a punching unit 41 that punches paper P, and an edge binder 42 that binds the edge of a paper bundle.

Paper P having passed through the edge binder 42 is stacked on a first stacker 43. Paper P that is not processed or is only punched in the first post-processing device 40 is stacked on a second stacker 45.

The first post-processing device 40 includes a saddle stitching unit 44 that produces a double-page book by central folding or saddle stitching of a paper bundle.

Figure 2:
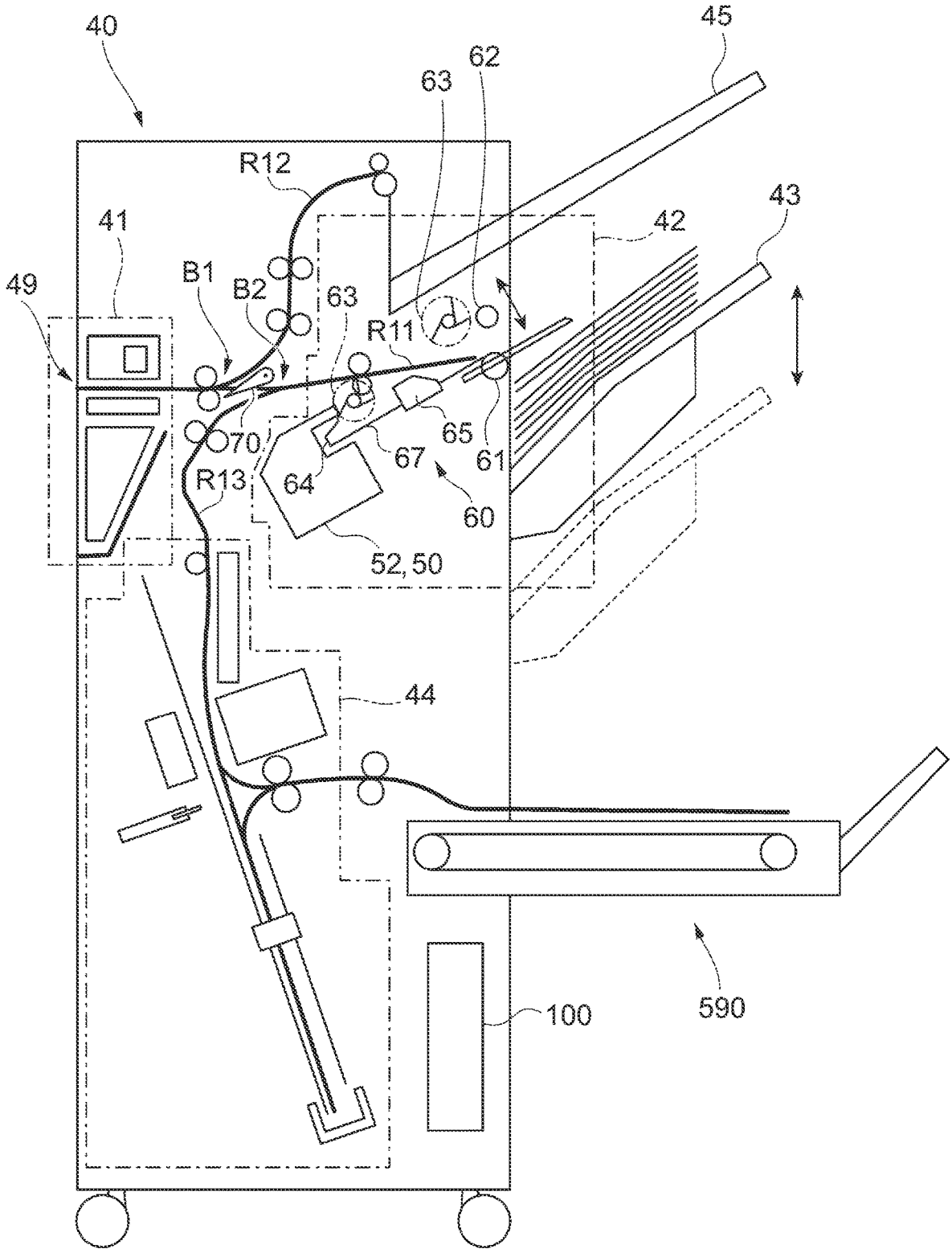
FIG. 2 illustrates the structure of a first post-processing device.

FIG. 2 illustrates the structure of the first post-processing device 40.

The first post-processing device 40 has an inlet 49 that receives paper P transported from the folding device 30.

The punching unit 41 is provided on an immediately downstream side of the inlet 49. The punching unit 41 punches two or four holes in the paper P transported to the first post-processing device 40.

A first paper transport path R11 is provided from the inlet 49 to the edge binder 42, and is used to transport the paper P received through the inlet 49 to the edge binder 42.

At a first branch portion B1, a second paper transport path R12 branches from the first paper transport path R11, and is used to transport the paper P to the second stacker 45.

At a second branch portion B2, a third paper transport path R13 branches from the first paper transport path R11, and is used to transport the paper P to the saddle stitching unit 44.

A switching gate 70 switches the transport destination of the paper P to any one of the first paper transport path R11 to the third paper transport path R13.

The edge binder 42 includes a paper collector 60 that produces a paper bundle by collecting a predetermined number of sheets of paper P.

The paper collector 60 includes a support plate 67 that is inclined from the horizontal direction and supports the transported paper P from the bottom. In this exemplary embodiment, the paper bundle is produced on the support plate 67.

The edge binder 42 includes a binding unit 50 that binds the edge of the produced paper bundle (edge binding).

The binding unit 50 of this exemplary embodiment is a binding unit 52 that binds the paper bundle without using staples.

The edge binder 42 includes a transport roller 61 that rotates to send the produced paper bundle to the first stacker 43. The edge binder 42 includes a movable roller 62 movable between a position where the movable roller 62 is retracted from the transport roller 61 and a position where the movable roller 62 is in press contact with the transport roller 61.

To perform the process in the edge binder 42, transported paper P is first received through the inlet 49.

Then, the paper P is transported along the first paper transport path R11 and reaches the edge binder 42.

The paper P transported to a point above the support plate 67 drops onto the support plate 67. The paper P is supported by the support plate 67 from the bottom and slides along the support plate 67 by the inclination of the support plate 67 and by a rotary member 63.

Then, the paper P abuts against an end guide 64 attached to the end of the support plate 67. In this exemplary embodiment, the end guide 64 extends upward from the end of the support plate 67 in the figure, and the paper P moving along the support plate 67 abuts against the end guide 64.

In this exemplary embodiment, the movement of the paper P is stopped in this manner. This operation is performed every time paper P is transported from the upstream side, and a paper bundle including a plurality of sheets of paper P stacked in alignment is produced on the support plate 67.

In this exemplary embodiment, paper widthwise position aligning members 65 align the position of the paper bundle in its width direction.

In this exemplary embodiment, every time paper P is fed onto the support plate 67, the edges (sides) of the paper P in its width direction are pushed by the paper widthwise position aligning member 65 and the position of the paper P (paper bundle) in the width direction is aligned.

When a predetermined number of sheets of paper P are stacked on the support plate 67, the binding unit 52 that is an example of a binder binds the edge of the paper bundle.

The binding unit 52 binds the paper bundle by pinching the paper bundle with two binding teeth to crimp the sheets of paper constituting the paper bundle.

In this exemplary embodiment, the movable roller 62 advances toward the transport roller 61, and the paper bundle is nipped by the movable roller 62 and the transport roller 61. Then, the transport roller 61 rotates to transport the paper bundle to the first stacker 43.

In this exemplary embodiment, the binding unit 52 is movable toward a far side or a near side of the drawing sheet of FIG. 2 to bind the sheets of paper P at a plurality of points.

The part including the edge binder 42 may be regarded as a binding apparatus that binds sheets of paper P.

To perform edge binding of the sheets of paper P in this exemplary embodiment, the sheets of paper P having images formed by the image forming apparatus 2 are transported to the edge binder 42. The edge binder 42 binds the transported sheets of paper P.

Figure 3:
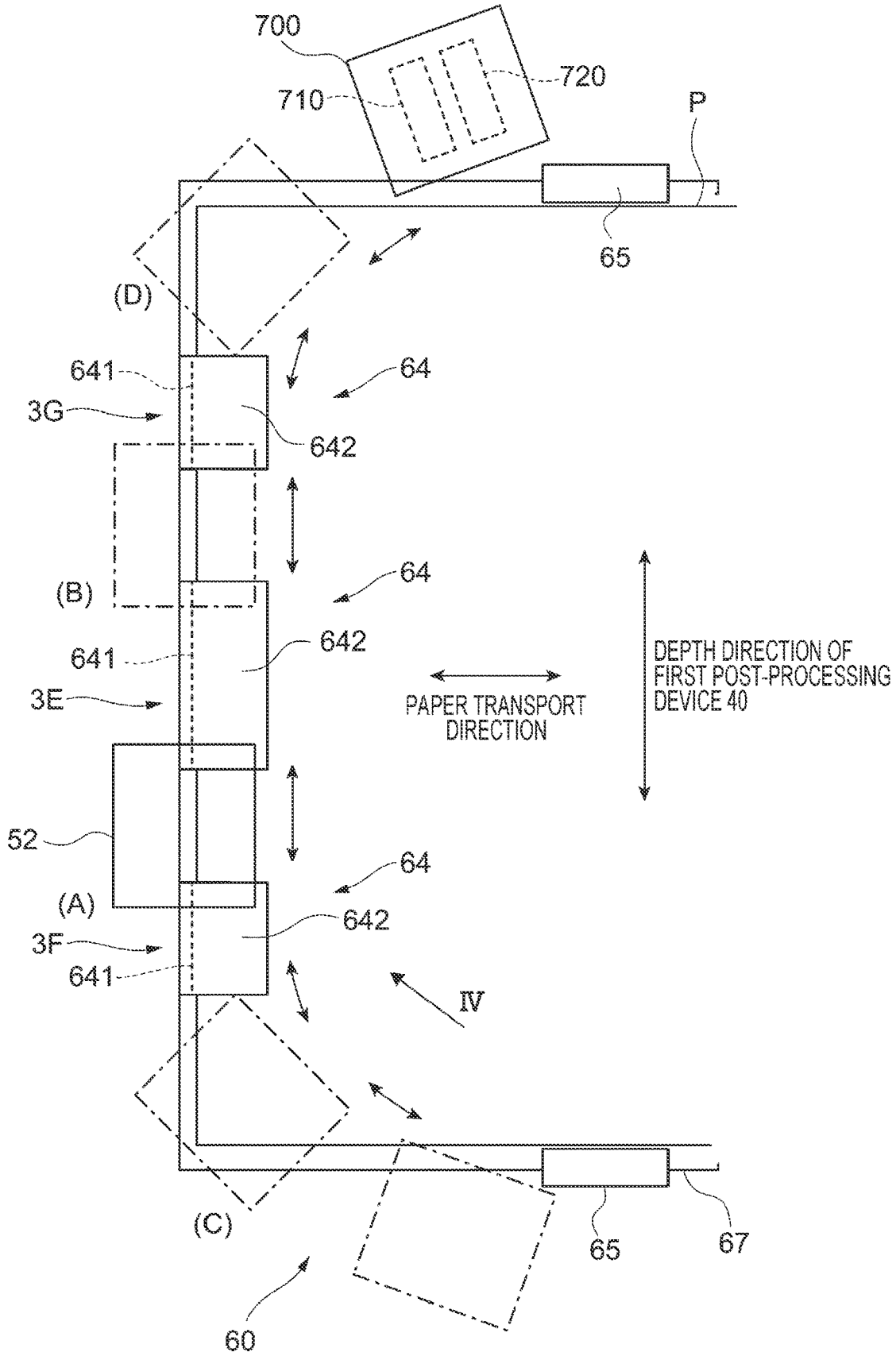
FIG. 3 is a top view of a paper collector.

Referring to FIG. 3 (top view of the paper collector 60), the binding unit 52 is provided in this exemplary embodiment as described above.

In this exemplary embodiment, a water adjusting mechanism 700 that is an example of a water adjuster adjusts water contained in the sheets of paper P collected by the paper collector 60.

In this exemplary embodiment, the water adjusting mechanism 700 adjusts water as appropriate every time paper P is transported to the edge binder 42. In other words, the water adjusting mechanism 700 adjusts water as appropriate for each sheet of paper in this exemplary embodiment.

The water adjusting mechanism 700 may adjust water after a paper bundle is produced.

The water adjusting mechanism 700 that is an example of the water adjuster includes a water supplier 710 and a water remover 720.

For example, the water supplier 710 includes an impregnator that is impregnated with water and advances to or retreats from paper P. The impregnator comes into contact with the paper P to supply water to the paper P. More specifically, the impregnator of the water supplier 710 comes into contact with a binding portion on the paper P to supply water to the binding portion.

For example, the water supplier 710 supplies water to the paper P by ejecting water to the paper P from a nozzle or a head. For example, the water supplier 710 supplies water to the paper P by dripping a water droplet from above the paper P.

The water supplied to the paper P is not limited to pure water and may contain any other component.

The water remover 720 includes a heat source to remove water from the binding portion on the paper P. In other words, the water remover 720 includes the heat source to dry the binding portion on the paper P.

For example, the water remover 720 removes water from the binding portion by blowing hot air over the binding portion to dry the binding portion.

Alternatively, the water remover 720 dries the binding portion by bringing an object heated by the heat source into contact with the binding portion to remove water from the binding portion.

For example, the water remover 720 dries the binding portion by pushing a water adsorbent against the binding portion to remove water from the binding portion.

The binding portion may be dried by drying the entire paper P instead of drying the binding portion alone.

In this exemplary embodiment, the water supplier 710 and the water remover 720 are movable but may be stationary.

In the case where the water supplier 710 and the water remover 720 are stationary, the water supplier 710 and the water remover 720 are provided, for example, at each binding position on the paper P.

The binding portion may be supplied with water or dried in the image forming apparatus 2 instead of in the edge binder 42 (see FIG. 1).

Alternatively, the binding portion may be supplied with water or dried, for example, in the process of transporting the paper P from the image forming apparatus 2 to the edge binder 42.

In other words, the binding portion may be supplied with water or dried on the transport path of the paper P toward the edge binder 42.

The binding unit 52 (see FIG. 3) and the water adjusting mechanism 700 are disposed at different positions in a depth direction of the first post-processing device 40.

In this exemplary embodiment, the binding unit 52 and the water adjusting mechanism 700 move along the depth direction of the first post-processing device 40 orthogonal to the transport direction of the paper P (paper bundle).

In this exemplary embodiment, the binding unit 52 and the water adjusting mechanism 700 move along one common path.

In this exemplary embodiment, the binding unit 52 is movable to bind a plurality of points on the paper bundle.

In this exemplary embodiment, the water adjusting mechanism 700 is movable to supply or remove water at a plurality of points on the paper bundle.

For example, the binding unit 52 stops at two different points (point (A) and point (B) in FIG. 3) in the depth direction of the first post-processing device 40 and binds the paper bundle at the two points (two-point edge binding).

For example, the binding unit 52 stops at one end of the paper bundle (one corner of the paper bundle) (point (D) in FIG. 3) and binds the paper bundle at this stop position (one-point edge binding).

For example, the binding unit 52 stops at another end of the paper bundle (another corner of the paper bundle) (point (C) in FIG. 3) and binds the paper bundle at this stop position (one-point edge binding).

The water adjusting mechanism 700 also stops at the two points described above (point (A) and point (B) in FIG. 3) and supplies or removes water at the two points.

For example, the water adjusting mechanism 700 stops at one end of the paper bundle (one corner of the paper bundle) (point (D) in FIG. 3) and supplies or removes water at this stop position.

For example, the water adjusting mechanism 700 stops at another end of the paper bundle (another corner of the paper bundle) (point (C) in FIG. 3) and supplies or removes water at this stop position.

In this exemplary embodiment, each of the binding unit 52 and the water adjusting mechanism 700 linearly moves between the points (A) and (B).

In this exemplary embodiment, each of the binding unit 52 and the water adjusting mechanism 700 moves along with rotation at, for example, 45° between the points (A) and (C) or between the points (B) and (D).

To move each of the binding unit 52 and the water adjusting mechanism 700, a drive source such as a motor is provided thereto. In this case, each of the binding unit 52 and the water adjusting mechanism 700 moves alone.

To move each of the binding unit 52 and the water adjusting mechanism 700, the binding unit 52 and the water adjusting mechanism 700 are attached to, for example, a movable belt. Then, the belt is moved. Thus, the binding unit 52 and the water adjusting mechanism 700 are moved.

In this exemplary embodiment, a plurality of end guides 64 are provided as illustrated in FIG. 3.

The end guides 64 are disposed at different positions in the depth direction of the first post-processing device 40 (direction orthogonal to the transport direction of the paper P).

As illustrated in FIG. 3, each end guide 64 includes a regulator 641 and a facing piece 642.

The regulator 641 is orthogonal to the support plate 67. In this exemplary embodiment, the end of paper P abuts against the regulator 641 to regulate movement of the paper P.

The facing piece 642 is connected to the regulator 641 and faces the support plate 67.

In this exemplary embodiment, when paper P is placed on the support plate 67, the end of the paper P enters a space between the facing piece 642 and the support plate 67. The end of the paper P abuts against the regulator 641. Thus, the paper P is aligned.

A paper bundle is bound at the point (A) in FIG. 3 through a space between the facing piece 642 (3E) at the center in FIG. 3 (center in a vertical direction) and the facing piece 642 (3F) on a lower side in FIG. 3.

Water is supplied or removed at the point (A) in FIG. 3 also through the space between the facing piece 642 (3E) at the center in FIG. 3 and the facing piece 642 (3F) on the lower side in FIG. 3.

A paper bundle is bound at the point (B) in FIG. 3 through a space between the facing piece 642 (3G) on an upper side in FIG. 3 and the facing piece 642 (3E) at the center in FIG. 3.

Water is supplied or removed at the point (B) in FIG. 3 also through the space between the facing piece 642 (3G) on the upper side in FIG. 3 and the facing piece 642 (3E) at the center in FIG. 3.

In this exemplary embodiment, the binding unit 52 does not use a binding member such as staples, but a binding unit using the binding member may be added.

In the case where the binding unit using the binding member is added, the binding unit to be used for binding is switched, for example, in response to an instruction from a user.

In this case, both the binding without the binding member and the binding with the binding member may be performed.

Figure 4:
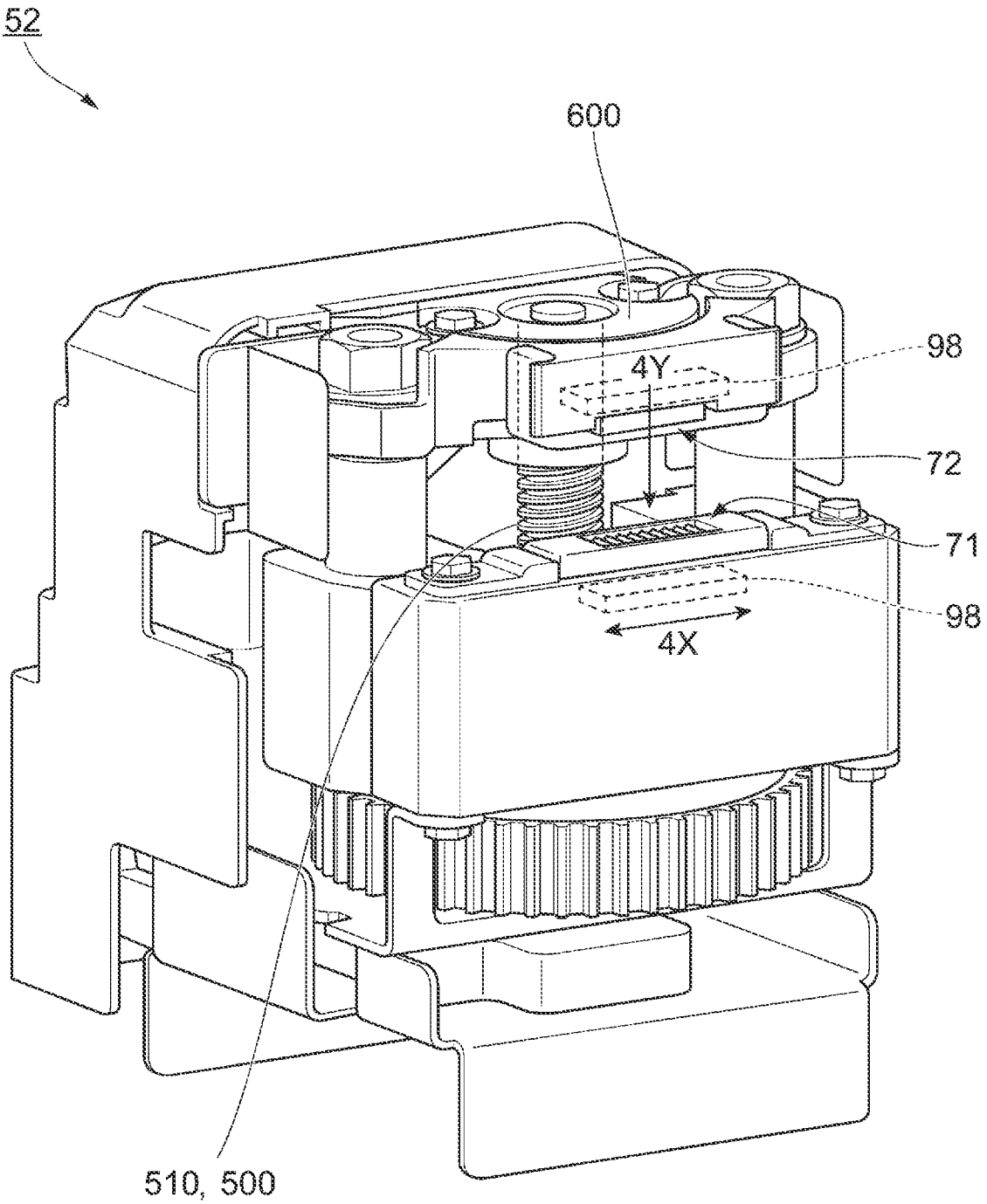
FIG. 4 illustrates a binding unit viewed in an arrow IV direction in FIG. 3.

FIG. 4 illustrates the binding unit 52 viewed in an arrow IV direction in FIG. 3.

The binding unit 52 that is an example of the binder includes first binding teeth 71 to be used to bind a paper bundle including a plurality of sheets of paper P.

Second binding teeth 72 are provided above the first binding teeth 71.

The first binding teeth 71 and the second binding teeth 72 have projections and depressions.

The projections and the depressions are alternately arranged in an arrow 4X direction in the figure on a surface of the first binding teeth 71 facing the second binding teeth 72 and on a surface of the second binding teeth 72 facing the first binding teeth 71.

In other words, the projections and the depressions are alternately arranged in a longitudinal direction of the first binding teeth 71 and the second binding teeth 72 on the surface of the first binding teeth 71 facing the second binding teeth 72 and on the surface of the second binding teeth 72 facing the first binding teeth 71.

To bind a paper bundle by the first binding teeth 71 and the second binding teeth 72, the second binding teeth 72 advance toward the first binding teeth 71.

To bind a paper bundle in this exemplary embodiment, the second binding teeth 72 descend toward the first binding teeth 71 along a linear path indicated by an arrow 4Y in the figure.

In this exemplary embodiment, a paper bundle (not illustrated) between the first binding teeth 71 and the second binding teeth 72 is pinched and pressed by the first binding teeth 71 and the second binding teeth 72.

In this exemplary embodiment, the projections of the first binding teeth 71 and the depressions of the second binding teeth 72 face each other. Further, the depressions of the first binding teeth 71 and the projections of the second binding teeth 72 face each other.

The projections of the binding teeth on one side enter the depressions of the binding teeth on the other side.

Thus, sheets of paper P constituting the paper bundle are bound by crimping. In this exemplary embodiment, the second binding teeth 72 then retreat upward from the first binding teeth 71.

In this exemplary embodiment, the projections and the depressions of the first binding teeth 71 and the second binding teeth 72 are alternately arranged, but may be arranged in other fashions.

The binding unit 52 includes a movement mechanism 500 that is an example of a mover configured to move the second binding teeth 72 toward the first binding teeth 71.

The movement mechanism 500 includes a rod-shaped screw member 510 extending along a vertical direction in the figure. The screw member 510 rotates in its circumferential direction to move the second binding teeth 72 toward the first binding teeth 71.

In this exemplary embodiment, an interlock portion 600 moves in conjunction with the second binding teeth 72. In this exemplary embodiment, the screw member 510 meshes with the interlock portion 600. In other words, the screw member 510 is connected to the interlock portion 600.

The movement mechanism 500 moves the second binding teeth 72 toward the first binding teeth 71 by rotating the screw member 510 meshing with the interlock portion 600 in the circumferential direction.

In this exemplary embodiment, the screw member 510 rotates in one circumferential direction in response to forward rotation of a drive motor (not illustrated) provided in the binding unit 52.

Therefore, the interlock portion 600 and the second binding teeth 72 descend and the second binding teeth 72 move toward the first binding teeth 71 to bind a paper bundle.

After the finish of binding, the screw member 510 rotates in a reverse direction in response to reverse rotation of the drive motor.

Therefore, the interlock portion 600 and the second binding teeth 72 ascend. The ascending second binding teeth 72 retreat from the first binding teeth 71.

In this exemplary embodiment, the second binding teeth 72 are moved by using the screw member 510, but the mechanism for moving the second binding teeth 72 is not particularly limited, and a cam mechanism or a jack mechanism may be used instead.

In this exemplary embodiment, the second binding teeth 72 are moved, but the first binding teeth 71 may be moved or both the first binding teeth 71 and the second binding teeth 72 may be moved.

In this exemplary embodiment, the binding unit 52 is configured to pass the end guide 64 in FIG. 3.

In this exemplary embodiment, the maximum separation distance between the first binding teeth 71 and the second binding teeth 72 is larger than the height dimension of the end guide 64. The binding unit 52 passes the end guide 64 through a space between the first binding teeth 71 and the second binding teeth 72.

Figure 5:
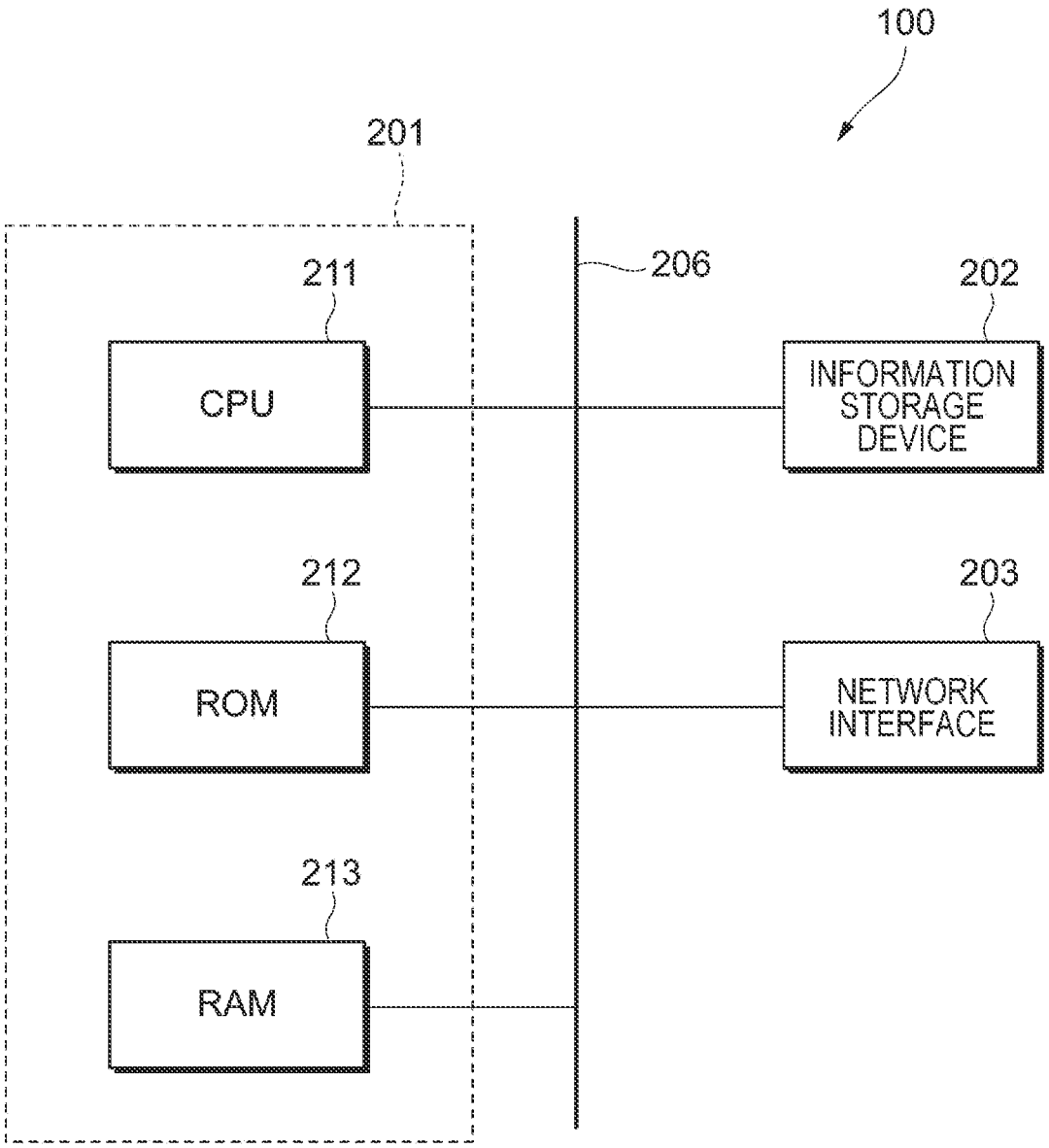
FIG. 5 illustrates the hardware configuration of an information processor.

FIG. 5 illustrates the hardware configuration of the information processor 100.

The information processor 100 includes a processing unit 201, an information storage device 202 that stores information, and a network interface 203 that performs communication via a local area network (LAN) cable or the like.

The processing unit 201 is a computer.

The processing unit 201 includes a central processing unit (CPU) 211 that is an example of a processor configured to execute various processes described later. The processing unit 201 includes a read only memory (ROM) 212 that stores software, and a random access memory (RAM) 213 to be used as a working area.

The information storage device 202 is implemented by existing devices such as a hard disk drive, a semiconductor memory, or a magnetic tape.

The processing unit 201, the information storage device 202, and the network interface 203 are connected through a bus 206 or signal lines (not illustrated).

Programs to be executed by the CPU 211 may be provided to the information processor 100 by being stored in a computer readable recording medium such as a magnetic recording medium (e.g., a magnetic tape or a magnetic disk), an optical recording medium (e.g., an optical disc), a magneto-optical recording medium, or a semiconductor memory. The programs may be provided to the information processor 100 by using communication means such as the Internet.

In the embodiments above, the term "processor" refers to hardware in a broad sense. Examples of the processor include general processors (e.g., CPU: Central Processing Unit) and dedicated processors (e.g., GPU: Graphics Processing Unit, ASIC: Application Specific Integrated Circuit, FPGA: Field Programmable Gate Array, and programmable logic device).

In the embodiments above, the term "processor" is broad enough to encompass one processor or plural processors in collaboration which are located physically apart from each other but may work cooperatively. The order of operations of the processor is not limited to one described in the embodiments above, and may be changed.

Specific Examples of Processes

The processes to be executed by the information processor 100 are described.

In this exemplary embodiment, the CPU 211 that is an example of the processor controls at least one of the binding unit 52 or the water adjusting mechanism 700 so that the proportion of the volume of water contained in a binding portion falls within a specific range.

More specifically, the CPU 211 controls at least one of the binding unit 52 or the water adjusting mechanism 700 so that the proportion of the volume of water contained in a binding portion on bound sheets of paper P to the volume of the binding portion falls within the specific range.

Thus, the proportion of the volume of water contained in the binding portion after the binding to the volume of the binding portion falls within the specific range.

Figure 6:
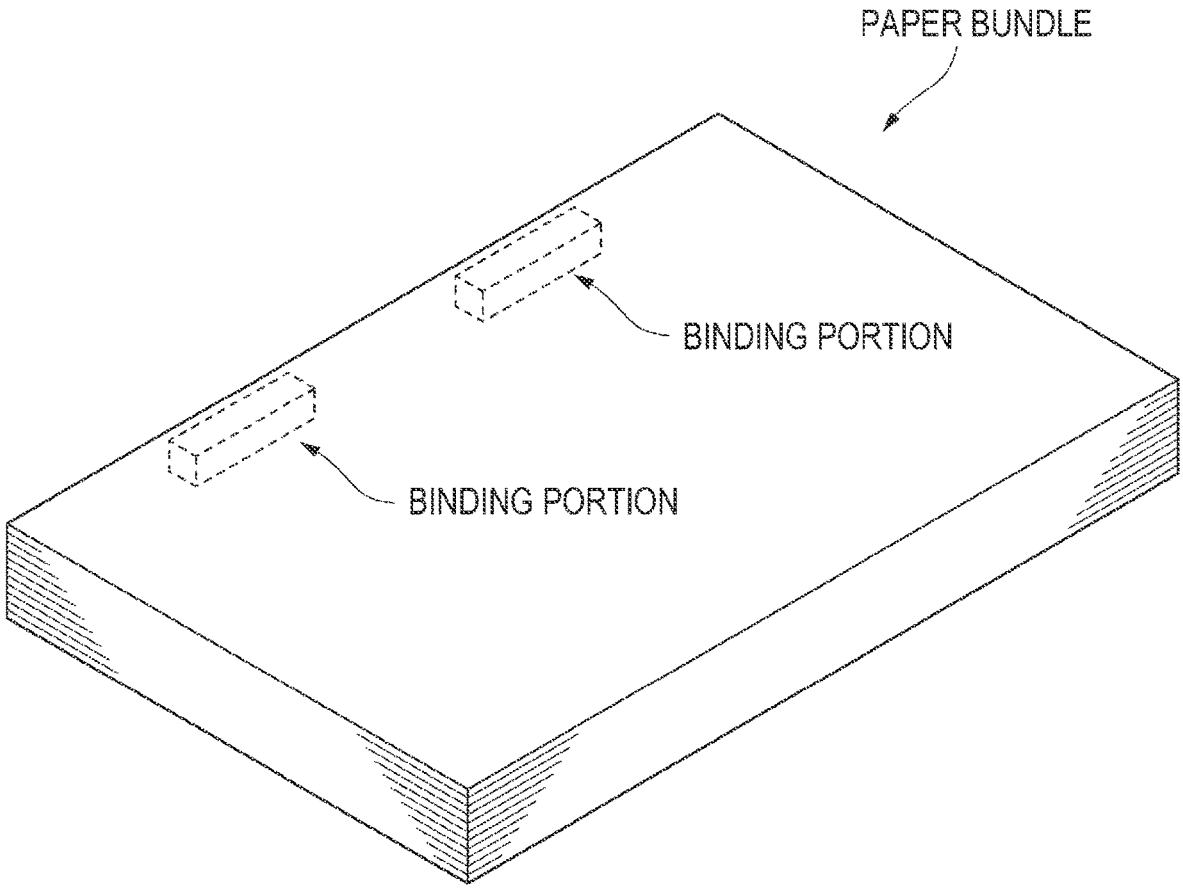
FIG. 6 illustrates a bound paper bundle.

The "volume of binding portion on bound sheets of paper P" herein means the volume of a binding portion on bound sheets of paper P as illustrated in FIG. 6 (illustrating a bound paper bundle). If a plurality of binding portions are present as illustrated in FIG. 6, the volume of the binding portion means the volume of each binding portion.

The "volume of binding portion on bound sheets of paper P" also means the volume of a space between the second binding teeth 72 and the first binding teeth 71 closest to each other.

The "volume of water contained in binding portion" means the volume of water contained in the binding portion on the bound sheets of paper P. If a plurality of binding portions are present, the volume of water means the volume of water contained in each binding portion.

For example, the volume of water may be acquired based on a post-subtraction value obtained by subtracting a post-drying weight of the dried binding portion from a post-binding weight of the binding portion immediately after the binding. More specifically, the volume may be acquired based on a post-subtraction value obtained by subtracting a post-drying weight of the binding portion that has stood still "for two hours in environment of 105° C." from the post-binding weight of the binding portion.

More specifically, the volume of water contained in the binding portion may be acquired by dividing the post-subtraction value by "1" that is the specific gravity of water.

Alternatively, the volume of water contained in the binding portion may be acquired based on a total water weight obtained by adding a standard weight of standard water (4% to 6%) contained in the binding portion at "humidity of 50% RH and 21° C." that is an example of a normal environment to a post-subtraction value obtained by subtracting a post-standing weight of the binding portion that has stood still for 24 hours in the normal environment from the post-binding weight of the binding portion.

More specifically, the volume of water contained in the binding portion may be acquired by dividing the total water weight by "1" that is the specific gravity of water.

In general, paper may contain about 4% to 6% of water at the humidity of 50% RH and 21° C. that is an example of the normal environment. Therefore, the volume of water contained in the binding portion may be acquired based on the total water weight obtained by acquiring a difference between the post-binding weight of the binding portion and the post-standing weight of the binding portion that has stood still in the normal environment and adding the standard weight of water (4% to 6%) in the normal environment to the acquired difference.

In this exemplary embodiment, the CPU 211 controls at least one of the binding unit 52 or the water adjusting mechanism 700 so that the proportion falls within a range of 25% to 50%.

Therefore, in this exemplary embodiment, the proportion of the volume of water contained in the binding portion to the volume of the binding portion falls within the range of 25% to 50%.

Figure 7:
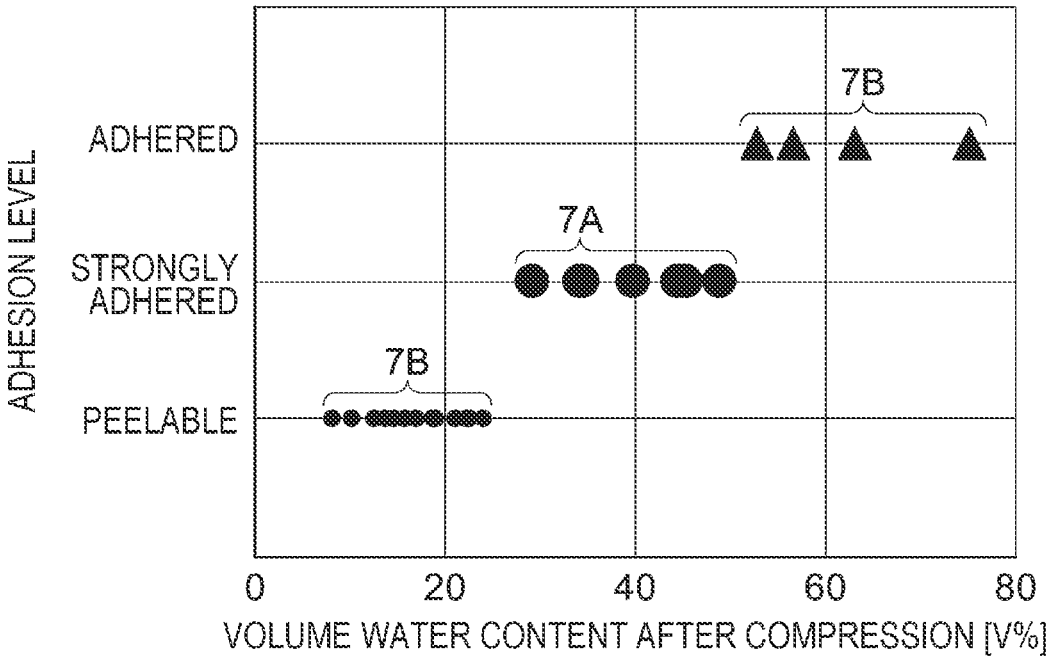
FIG. 7 illustrates paper adhesion forces.

An experiment conducted by the inventors demonstrates that, as indicated by a symbol 7A in FIG. 7 (illustrating adhesion forces of sheets of paper P), the adhesion force of sheets of paper constituting a paper bundle increased and the binding was not easily collapsed under the condition that the proportion was within the range of 25% to 50% that was an example of the specific range.

The experiment demonstrates that, as indicated by a symbol 7B in FIG. 7, the binding strength under the condition that the proportion was outside the range of 25% to 50% decreased compared with the case where the proportion was within the range of 25% to 50%.

More specifically, under the condition that the proportion was within the range of 25% to 50%, the binding was not easily collapsed even though the upmost paper P in the paper bundle was manually pulled away from the paper bundle.

Under the condition that the proportion was outside the range of 25% to 50%, the binding was easily collapsed when the upmost paper P in the paper bundle was manually pulled away from the paper bundle.

In general, the binding force increases as the compression level of the binding portion increases. As the compression level increases, the amount of water in the binding portion relatively increases. If the amount of water is excessive, the binding strength decreases.

In general, the binding force decreases as the compression level of the binding portion decreases. If the amount of water contained in the binding portion increases, fibers of sheets of paper P easily adhere to each other and the adhesion strength of the sheets of paper increases.

In general, the fibers of the sheets of paper P easily adhere to each other when the amount of water contained in the binding portion increases. If the amount of water is excessive, however, the fibers do not easily adhere to each other.

In general, the adhesion strength of the fibers of the sheets of paper P tends to decrease if the amount of water contained in the binding portion decreases. If the compression level of the binding portion increases, the amount of water relatively increases and the binding strength increases.

In view of the background described above, in this exemplary embodiment, a binding-period condition during the binding of a paper bundle is set to increase the adhesion strength between sheets of paper.

In this exemplary embodiment, if the binding-period condition is not appropriate to keep the proportion within the specific range, the CPU 211 performs control to keep the proportion within the specific range.

If the amount of water contained in the binding portion on the paper P is excessively large or small or if the advancing amount of the second binding teeth 72 is excessively large or small, the binding-period condition is not appropriate to keep the proportion within the specific range.

In this case, the CPU 211 changes a current set value to change the binding-period condition to a condition under which the proportion falls within the specific range.

In other words, if the binding-period condition is a non-applicable condition under which the proportion does not fall within the specific range, the CPU 211 changes the current set value.

In this case, the CPU 211 changes the current setting to change the binding-period condition to the condition under which the proportion falls within the specific range.

The CPU 211 controls the binding unit 52 and the water adjusting mechanism 700 based on the changed setting. In other words, the CPU 211 controls the binding unit 52 and the water adjusting mechanism 700 based on the changed set value. Thus, the proportion falls within the specific range.

In this case, the CPU 211 controls at least one of the binding unit 52 or the water adjusting mechanism 700 so that the proportion of the volume of water contained in the binding portion to the volume of the binding portion falls within the specific range.

[Case where Binding-Period Condition is Condition Under which Proportion is Lower than Lower Limit of Specific Range]

For example, if the binding-period condition is a condition under which the proportion is lower than a lower limit of the specific range, the CPU 211 sets the water adjusting mechanism 700 to supply water to the paper P or sets the water adjusting mechanism 700 to increase the amount of water supplied to the paper P.

If the water adjusting mechanism 700 is currently set not to supply water to the paper P and the binding-period condition is the condition under which the proportion is lower than the lower limit of the specific range, the CPU 211 sets the water adjusting mechanism 700 to supply water to the paper P.

If the water adjusting mechanism 700 is currently set to supply water to the paper P and the binding-period condition is the condition under which the proportion is lower than the lower limit of the specific range, the CPU 211 sets the water adjusting mechanism 700 to increase the amount of water supplied to the paper P.

The CPU 211 determines whether the binding-period condition is the condition under which the proportion is lower than the lower limit of the specific range, for example, based on a currently set advancing amount of the second binding teeth 72 and a currently set water adjustment amount of the water adjusting mechanism 700.

In this exemplary embodiment, a relational table showing relationships among the advancing amount, the water adjustment amount, and the proportion (see FIG. 8) is registered in the information storage device 202 (see FIG. 5). The CPU 211 acquires a current proportion based on a currently set advancing amount, a currently set water adjustment amount, and the information registered in the relational table, and then determines whether the acquired current proportion falls within the specific range.

If the binding-period condition is the condition under which the current proportion is lower than the lower limit of the specific range, for example, the CPU 211 sets the water adjusting mechanism 700 to supply water to the binding portion or sets the water adjusting mechanism 700 to increase the amount of water supplied to the binding portion.

In this case, the CPU 211 refers to the relational table again to acquire a new set value for the water adjusting mechanism 700 so that the proportion falls within the specific range.

The CPU 211 controls the water adjusting mechanism 700 based on the acquired set value. Therefore, water is supplied to the binding portion or the amount of water supplied to the binding portion increases, and the proportion falls within the specific range.

If the binding-period condition is the condition under which the proportion is lower than the lower limit of the specific range, the CPU 211 sets an increase in the advancing amount of the second binding teeth 72 toward the paper bundle.

In this setting as well, the CPU 211 first refers to the relational table to determine whether the current proportion falls within the specific range.

If the current proportion is lower than the lower limit of the specific range, the CPU 211 sets an increase in the advancing amount of the second binding teeth 72 toward the paper bundle.

Specifically, the CPU 211 refers to the relational table to acquire a new set value of the advancing amount so that the proportion falls within the specific range.

The CPU 211 controls the binding unit 52 based on the acquired set value. Therefore, the advancing amount of the second binding teeth 72 increases, and the proportion falls within the specific range.

In the above, if the binding-period condition is the condition under which the proportion is lower than the lower limit of the specific range, the new setting is made on the water supply or the advancing amount.

The new setting may be made on both the water supply and the advancing amount so that the proportion falls within the specific range.

In other words, the setting may be made to supply water to the paper P or increase the amount of water supplied to the paper P and to increase the advancing amount so that the proportion falls within the specific range.

[Case where Binding-Period Condition is Condition Under which Proportion is Higher than Upper Limit of Specific Range]

For example, if the binding-period condition is a condition under which the proportion is higher than an upper limit of the specific range, that is, a condition under which the water amount relative to the volume of the binding portion relatively increases, the CPU 211 sets the water adjusting mechanism 700 to dry the binding portion or sets the water adjusting mechanism 700 to increase the drying level for the binding portion.

In this case, the CPU 211 sets the water adjusting mechanism 700 to heat the binding portion or sets the water adjusting mechanism 700 to increase the heating level for the binding portion.

Also in this case, the CPU 211 refers to the relational table to acquire a new set value for the water adjusting mechanism 700 so that the proportion falls within the specific range.

If the binding-period condition is the condition under which the proportion is higher than the upper limit of the specific range, the CPU 211 sets the water adjusting mechanism 700 not to supply water to the binding portion or sets the water adjusting mechanism 700 to reduce the amount of water supplied to the binding portion.

Also in this case, the CPU 211 refers to the relational table to acquire a new set value for the water adjusting mechanism 700 so that the proportion falls within the specific range.

If the binding-period condition is the condition under which the proportion is higher than the upper limit of the specific range, for example, the CPU 211 sets a reduction in the advancing amount of the second binding teeth 72 of the binding unit 52 toward the paper bundle.

Also in this case, the CPU 211 refers to the relational table to acquire a new set value for the binding unit 52 so that the proportion falls within the specific range.

Similarly to the above, if the binding-period condition is the condition under which the proportion is higher than the upper limit of the specific range, the new setting may be made on both the water supply and the advancing amount so that the proportion falls within the specific range.

For example, the setting may be made to dry the paper bundle or increase the drying level and to reduce the advancing amount so that the proportion falls within the specific range.

For example, the setting may be made not to supply water to the paper bundle or to reduce the amount of water supplied to the paper bundle and to reduce the advancing amount so that the proportion falls within the specific range.

[Processes in Case where Settings are Changed]

In this exemplary embodiment, if the setting is changed on one of the binding unit 52 or the water adjusting mechanism 700, the CPU 211 makes a setting on the other so that the proportion falls within the specific range.

For example, if the user sets a reduction in the advancing amount of the second binding teeth 72 and the proportion is lower than the lower limit of the specific range, the CPU 211 sets the water adjusting mechanism 700 to supply water or sets the water adjusting mechanism 700 to increase the amount of water supplied to the paper P.

In this case, the CPU 211 refers to the relational table to make a new setting on the water adjusting mechanism 700. Thus, the proportion falls within the specific range.

For example, if the user sets an increase in the advancing amount of the second binding teeth 72 and the proportion is higher than the upper limit of the specific range, the CPU 211 refers to the relational table to make a new setting on the water adjusting mechanism 700. Thus, the proportion falls within the specific range.

Specifically, if the user sets an increase in the advancing amount of the second binding teeth 72 and the proportion is higher than the upper limit of the specific range, the CPU 211 sets the water adjusting mechanism 700 to dry the paper P or sets the water adjusting mechanism 700 to increase the drying level for the paper P. Thus, the proportion falls within the specific range.

If the user sets an increase in the advancing amount of the second binding teeth 72 and the proportion is higher than the upper limit of the specific range, for example, the CPU 211 sets the water adjusting mechanism 700 to reduce the amount of water supplied to the paper P or sets the water adjusting mechanism 700 not to supply water to the paper P. Also in this case, the proportion falls within the specific range.

For example, if the user sets the water adjusting mechanism 700 to supply water or sets the water adjusting mechanism 700 to increase the amount of supplied water and the proportion is higher than the upper limit of the specific range, the CPU 211 sets a reduction in the advancing amount of the second binding teeth 72.

In this case, the CPU 211 refers to the relational table to make a new setting on the binding unit 52. Thus, the proportion falls within the specific range.

For example, if the user sets the water adjusting mechanism 700 not to supply water or sets the water adjusting mechanism 700 to reduce the amount of supplied water and the proportion is lower than the lower limit of the specific range, the CPU 211 sets an increase in the advancing amount of the second binding teeth 72.

Also in this case, the CPU 211 refers to the relational table to make a new setting on the binding unit 52. Thus, the proportion falls within the specific range.

In this exemplary embodiment, based on the setting on one of the binding unit 52 or the water adjusting mechanism 700, the CPU 211 makes a setting on the other as described above.

Although the setting is made on the other side by referring to the relational table in the above, thresholds may be set for the advancing amount and the water amount and the setting is made on the other side if the set value of one side has exceeded the threshold.

In other words, if the set value of one side has exceeded the threshold, the set value of the other side may be changed.

For example, if the newly set advancing amount is larger than a predetermined threshold, the CPU 211 sets the water adjusting mechanism 700 to reduce the amount of water contained in the paper bundle.

If the newly set advancing amount is smaller than a predetermined threshold, the CPU 211 sets the water adjusting mechanism 700 to increase the amount of water contained in the paper bundle.

If the newly set water amount is larger than a predetermined threshold, the CPU 211 sets the binding unit 52 to reduce the advancing amount of the second binding teeth 72.

For example, if the newly set water amount is smaller than a predetermined threshold, the CPU 211 sets the binding unit 52 to increase the advancing amount of the second binding teeth 72.

As described above, it is appropriate that the setting be made on the other one of the binding unit 52 or the water adjusting mechanism 700 based on the setting on one of the binding unit 52 or the water adjusting mechanism 700 so that the proportion falls within the specific range.

The setting may be made on the other side so that the proportion approaches the specific range instead of falling within the specific range.

Although the user makes the new setting in the above, the device may automatically make the new setting on one side. Also in this case, the CPU 211 makes the setting on the other side based on the new setting on one side in this exemplary embodiment.

Also in this case, the proportion falls within or approaches the specific range.

[Control to Keep Proportion Outside Specific Range]

The CPU 211 may switch control to keep the proportion within the specific range and control to keep the proportion outside the specific range in response to an instruction from the user.

In other words, the CPU 211 may perform the control to keep the proportion outside the specific range in response to the instruction from the user.

[Drying after Binding]

In the above, the sheets of paper P are dried by removing water from the sheets of paper P before the binding of the sheets of paper P. The sheets of paper P may be dried after the binding of the sheets of paper P.

In this case, the CPU 211 performs control to dry the binding portion of the sheets of paper P after the binding of the sheets of paper P.

After the binding, the binding portion may be dried not only by heating the binding portion after the binding but also by heating the binding portion with the remaining heat generated by heating the binding portion before the binding.

Also in the case of heating the binding portion after the binding, the binding portion may be heated before the binding and then further heated after the binding.

If the amount of water contained in the binding portion of the sheets of paper P is large, the adhesion strength of the sheets of paper P decreases and the binding may be collapsed, for example, when the user turns pages.

If the proportion is higher than the upper limit of the specific range after the binding, the adhesion strength of the sheets of paper decreases and the binding may be collapsed, for example, when the user turns pages.

If the binding portion is dried after the binding by heating the binding portion as in this exemplary embodiment, the amount of water in the binding portion is reduced and the adhesion strength of the sheets of paper increases.

In other words, if the binding portion is dried after the binding by heating the binding portion, the proportion falls within or approaches the specific range and the adhesion strength of the sheets of paper increases.

For example, the CPU 211 performs control to dry the binding portion after the binding so that the water contained in the binding portion falls within the specific range.

More specifically, the CPU 211 performs control to dry the binding portion so that the proportion of the volume of water contained in the binding portion on the bound sheets of paper P to the volume of the binding portion falls within the specific range.

In the above, the proportion is kept within the specific range by changing the binding-period condition before the binding. The proportion may be kept within the specific range by drying after the binding.

To dry the binding portion after the binding, for example, the water adjusting mechanism 700 first supplies water to the binding portion before the binding by the binding unit 52.

Then, the CPU 211 performs control to heat the binding portion after the binding, thereby drying the binding portion after the binding.

For example, the CPU 211 activates the water remover 720 of the water adjusting mechanism 700 after the sheets of paper P are bound by the binding unit 52 to heat the binding portion. Thus, the binding portion is dried.

More specifically, the CPU 211 performs control to heat the binding portion by blowing hot air over the binding portion or bringing an object heated by the heat source into contact with the binding portion. Thus, the water contained in the binding portion supplied with water is reduced.

Although the binding portion is dried after the water supply, the binding portion may be dried without the water supply.

Under a specific condition that the paper P is recycled paper or the binding is performed in a high-humidity environment, the amount of water contained in the binding portion may be large without the water supply.

In this case, the proportion falls within or approaches the specific range by drying the binding portion.

For example, a relatively large amount of water may be supplied to the binding portion before the binding and the amount of water may be reduced by drying after the binding.

Specifically, the water adjusting mechanism 700 supplies water to the binding portion before the binding so that the amount of water contained in the binding portion becomes larger than a predetermined threshold.

Then, the CPU 211 performs control to dry the binding portion so that the amount of water contained in the binding portion becomes smaller than the predetermined threshold.

More specifically, water is supplied before the binding so that the proportion becomes higher than the upper limit of the specific range.

In this case, control is performed to dry the binding portion after the binding so that the proportion higher than the upper limit of the specific range falls within the specific range.

The sheets of paper P may be heated before the binding of the sheets of paper P.

In this case, the CPU 211 may perform control to dry the binding portion after the binding by increasing the temperature of the heating that is performed before the binding of the sheets of paper P.

In this exemplary embodiment, the fixing device 14 of the image forming apparatus 2 (see FIG. 1) fixes an image on the paper P onto the paper P by heating the paper P before the binding of the sheets of paper P.

For example, the CPU 211 may perform control to dry the binding portion after the binding by increasing the temperature of the heating of the paper P in the fixing device 14.

For example, as illustrated in FIG. 4, the binding portion may be heated by providing heating sources 98 that heat the first binding teeth 71 and the second binding teeth 72 and binding the sheets of paper with the heated first binding teeth 71 and the heated second binding teeth 72.

Specifically, the CPU 211 causes the heating sources 98 to heat the first binding teeth 71 and the second binding teeth 72 if a predetermined condition is satisfied as in a case where water is supplied to the binding portion or the proportion is higher than the upper limit of the specific range.

Also in this case, the binding portion is dried after the binding.

Although both the first binding teeth 71 and the second binding teeth 72 are heated, either the first binding teeth 71 or the second binding teeth 72 may be heated alone.

The CPU 211 may perform control to prevent the user from touching the sheets of paper P until a predetermined period elapses after the binding of the sheets of paper P, thereby naturally drying the binding portion.

For example, the CPU 211 causes the information display 915 (see FIG. 1) to notify the user not to touch the sheets of paper P until the predetermined period elapses.

More specifically, the CPU 211 causes the information display 915 to display information "Please do not touch the sheets of paper P until five minutes elapse."

For example, the first post-processing device 40 (see FIG. 1) may include a stopper that stops the bound sheets of paper P.

In this case, the CPU 211 causes the stopper to stop the bound sheets of paper P until a predetermined period elapses, thereby naturally drying the bound sheets of paper P.

In response to the elapse of the predetermined period, the CPU 211 causes the stopper to output the sheets of paper P to the first stacker 43 outside the first post-processing device 40.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A binding apparatus comprising:

a binder configured to bind sheets of paper by advancing binding teeth toward the sheets of paper;

a water adjuster configured to adjust an amount of water contained in the sheets of paper; and a processor configured to:

based on a setting on one of the binder or the water adjuster, make a setting on the other one of the binder or the water adjuster, and set an advancing amount of the binding teeth to be advanced toward the sheets of paper by the binder based on a setting on the amount of water to be supplied to the sheets of paper by the water adjuster.

2. The binding apparatus according to claim 1, wherein the processor is configured to:

set the amount of water to be adjusted by the water adjuster based on a setting on the advancing amount of the binding teeth to be advanced toward the sheets of paper by the binder.

3. The binding apparatus according to claim 2, wherein the processor is configured to:

set the water adjuster to reduce the amount of water contained in the sheets of paper if the advancing amount is set larger than a predetermined threshold.

4. The binding apparatus according to claim 2, wherein the processor is configured to:

set the water adjuster to increase the amount of water contained in the sheets of paper if the advancing amount is set smaller than a predetermined threshold.

5. The binding apparatus according to claim 1, wherein the processor is configured to:

set the binder to reduce the advancing amount of the binding teeth if the amount of water is set larger than a predetermined threshold so that the amount of water contained in the sheets of paper increases.

6. The binding apparatus according to claim 1, wherein the processor is configured to:

set the binder to increase the advancing amount of the binding teeth if the amount of water is set smaller than a predetermined threshold so that the amount of water contained in the sheets of paper decreases.

7. A binding apparatus comprising:

a binder configured to bind sheets of paper by advancing binding teeth toward the sheets of paper;

a water adjuster configured to adjust an amount of water contained in the sheets of paper; and a processor configured to control at least one of the binder or the water adjuster, wherein the processor is configured to:

control at least one of the binder or the water adjuster so that a proportion of a volume of water contained in a binding portion on the sheets of paper bound by the binder to a volume of the binding portion falls within a specific range, and set an advancing amount of the binding teeth to be advanced toward the sheets of paper by the binder based on a setting on the amount of water to be supplied to the sheets of paper by the water adjuster.

8. The binding apparatus according to claim 7, wherein the processor is configured to:

control at least one of the binder or the water adjuster so that the proportion falls within a range of 25% to 50%.

9. The binding apparatus according to claim 7, wherein the processor is configured to:

if a binding-period condition during binding of the sheets of paper is a non-applicable condition under which the proportion does not fall within the specific range, change a setting on at least one of the binder or the water adjuster to change the binding-period condition to a condition under which the proportion falls within the specific range.

10. The binding apparatus according to claim 9, wherein the processor is configured to:

if the binding-period condition is a condition under which the proportion is lower than a lower limit of the specific range, cause the water adjuster to supply water to the sheets of paper or cause the water adjuster to increase the amount of water to be supplied to the sheets of paper.

11. The binding apparatus according to claim 9, wherein the processor is configured to:

if the binding-period condition is a condition under which the proportion is lower than a lower limit of the specific range, cause the binder to increase the advancing amount of the binding teeth to be advanced toward the sheets of paper.

12. The binding apparatus according to claim 9, wherein the processor is configured to:

if the binding-period condition is a condition under which the proportion is higher than an upper limit of the specific range, cause the water adjuster to dry the sheets of paper or cause the water adjuster to increase a drying level for the sheets of paper.

13. The binding apparatus according to claim 9, wherein the processor is configured to:

if the binding-period condition is a condition under which the proportion is higher than an upper limit of the specific range, cause the binder to reduce the advancing amount of the binding teeth to be advanced toward the sheets of paper.

14. The binding apparatus according to claim 7, wherein the processor is configured to:

if the binder is set to reduce the advancing amount of the binding teeth and the proportion is lower than a lower limit of the specific range, cause the water adjuster to supply water or cause the water adjuster to increase the amount of water to be supplied to the sheets of paper so that the proportion falls within the specific range.

15. The binding apparatus according to claim 7, wherein the processor is configured to:

if the binder is set to increase the advancing amount of the binding teeth and the proportion is higher than an upper limit of the specific range, cause the water adjuster to dry the sheets of paper or cause the water adjuster to increase a drying level for the sheets of paper so that the proportion falls within the specific range.

16. The binding apparatus according to claim 7, wherein the processor is configured to:

if the water adjuster is set to supply water or is set to increase the amount of water to be supplied and the proportion is higher than an upper limit of the specific range, cause the binder to reduce the advancing amount of the binding teeth so that the proportion falls within the specific range.

17. The binding apparatus according to claim 7, wherein the processor is configured to:

if the water adjuster is set not to supply water or is set to reduce the amount of water to be supplied and the proportion is lower than a lower limit of the specific range, cause the binder to increase the advancing amount of the binding teeth so that the proportion falls within the specific range.

18. The binding apparatus according to claim 7, wherein the processor is configured to:

switch control to keep the proportion within the specific range and control to keep the proportion outside the specific range in response to an instruction from a user.

19. A binding apparatus comprising:

a binding means for binding sheets of paper by advancing binding teeth toward the sheets of paper;

a water adjusting means for adjusting an amount of water contained in the sheets of paper; and processing means for, based on a setting on one of the binding means or the water adjusting means, making a setting on the other one of the binding means or the water adjusting means, and for setting an advancing amount of the binding teeth to be advanced toward the sheets of paper by the binding means based on a setting on the amount of water to be supplied to the sheets of paper by the water adjuster.

* * * * *